United States Patent [19]

Koddenberg et al.

[11] 4,382,841

[45] May 10, 1983

[54] APPARATUS FOR OPERATING OFFTAKE AND MAIN VALVES

[75] Inventors: Theo Koddenberg; Dieter Janssen, both of Bochum, Fed. Rep. of Germany

[73] Assignee: Dr. C. Otto & Comp. G.m.b.H., Bochum, Fed. Rep. of Germany

[21] Appl. No.: 316,075

[22] Filed: Oct. 29, 1981

[30] Foreign Application Priority Data

Nov. 13, 1980 [DE] Fed. Rep. of Germany ..... 3042792

[51] Int. Cl.[3] ..... C10B 27/06; C10B 29/00

[52] U.S. Cl. ..... 202/256; 202/258; 202/270

[58] Field of Search ..... 202/255–258, 202/269, 270; 137/627.5

[56] References Cited

U.S. PATENT DOCUMENTS

| | | | |
|---|---|---|---|
| 1,847,804 | 3/1932 | Allen | 202/258 |
| 3,580,815 | 5/1971 | Tucker | 202/258 |
| 3,858,609 | 1/1975 | Stanke et al. | 202/258 |

FOREIGN PATENT DOCUMENTS

| | | | |
|---|---|---|---|
| 433798 | 1/1980 | U.S.S.R. | 202/258 |
| 755828 | 8/1980 | U.S.S.R. | 202/270 |

*Primary Examiner*—Bradley Garris

*Attorney, Agent, or Firm*—Thomas H. Murray

[57] ABSTRACT

A gas conduit control system for a coking oven provides for sequential operation of a conduit cover and a seal on a transition element which communicates between the conduit and a gas collection main conduit. The system includes two pivotally connected shafts and two bell crank levers wherein the cover element is connected to one bell crank lever and the seal is connected to the other bell crank lever. One bell crank lever is slotted to permit linear movement of a first shaft without accompanying movement of the associated bell crank lever. The other bell crank lever is pinned to a lengthwise slot in a second shaft to permit lengthwise movement of the second shaft without accompanying movement of that bell crank lever. A hydraulic piston is an element of the first shaft which operates the system by extension and retraction.

9 Claims, 4 Drawing Figures

APPARATUS FOR OPERATING OFFTAKE AND MAIN VALVES

BACKGROUND OF THE INVENTION

Field of the Invention—This invention relates to apparatus for operating coke oven gas conduits whereby the cover of a gas offtake pipe is opened and closed and consecutively a seal between the gas offtake pipe and a gas collection main conduit is operated in a predetermined sequence.

Description of the Prior Art—In the operation of by-product coke ovens, a gas offtake pipe in the crown of the coke oven is connected to a gas collection main conduit for delivering gases, tars and vapors from the coking process. As the coking process is ended, the generation of gases, tars and vapors diminishes and the interior of the coke oven can be vented to the atmosphere through the gas offtake pipe. However, it is necessary that the bypass connection to the gas collection main conduit be closed prior to the opening of the atmospheric vent. Similarly when a new coking charge is initiated, it is necessary to close the atmospheric vent and thereafter to open the communication between the gas offtake pipe and the gas collection main conduit.

In German Pat. No. 2,230,087 the problem is addressed and an adjusting mechanism is provided which at one end acts on the gas offtake pipe cover and at the other end acts on the lid or flap or a closure valve between the gas offtake pipe and the gas collection main conduit. In this device the torque required to open the cover is greater than the torque required to close the flap and conversely the torque required to open the flap is greater than the torque required to close the cover.

There is still a need for a single operating unit which will sequentially operate the gas offtake pipe cover and the seal which is between the gas offtake pipe to the gas collection main conduit. The operation must occur in the proper sequence to preclude atmospheric pollution and loss of valuable coal distillation products.

DESCRIPTION OF THE INVENTION

The principal object of the invention is to provide an apparatus which insures that the two changeover events, that is, (a) closure and opening of the seal between the offtake gas pipe and the gas collection main conduit and (b) the opening and closure of the gas offtake pipe cover, occur consecutively whereby the second changeover occurs only after the first changeover is completed.

The present invention includes a retractable and extendible first shaft which is connected by a first pin to the bottom of a second shaft which is connected at its upper end by a second pin to a first bell arm crank which is secured to the gas offtake pipe cover. The upper end of the second shaft includes a slot in which the second pin is positioned so that the second shaft can travel for an appreciable distance before moving the second pin and hence the cover. The other end of the first bell crank arm is weighted to urge the cover normally into a closed position. The first pin member is connected to a second bell crank arm which has one arm connected to the seal between the gas offtake pipe and the gas collection main conduit. The first pin is positioned in a slot in the other arm of the second bell crank arm so that the first shaft can move an appreciable distance without affecting movement of the seal out of its closed position.

With the first shaft in its retracted, bottommost position, the cover is closed and the seal is open. With the first shaft in its extended, uppermost position, the cover is open and the seal is closed.

In a preferred embodiment of the invention, the apparatus is positioned between adjacent gas offtake pipes and is equipped to operate the covers and seals in each of the two gas offtake pipes. This is accomplished by having two first shafts which have forked ends to permit articulation of the second bell crank arms about the first pin. The first pin is parallel to the axis of the gas collection main conduit. Hence the second bell crank arms move in a plane which is perpendicular to the longitudinal axis of the gas collection main conduit.

In the preferred embodiment, the first pivot pin has mounted upon it, proceeding from outside to inside, the upper forked ends of the first shaft, the lower forked ends of the second shaft, the second bell crank lever arm which has a slot in which the said first pin is received. Preferably the bell crank lever arms are fabricated from flat bar stock.

A pair of rails is provided symmetrically with respect to the first shafts and secured laterally of the gas offtake pipe. The rails function to guide the first pin in its vertical travel.

DESCRIPTION OF THE PREFERRED EMBODIMENTS

Figure 1:
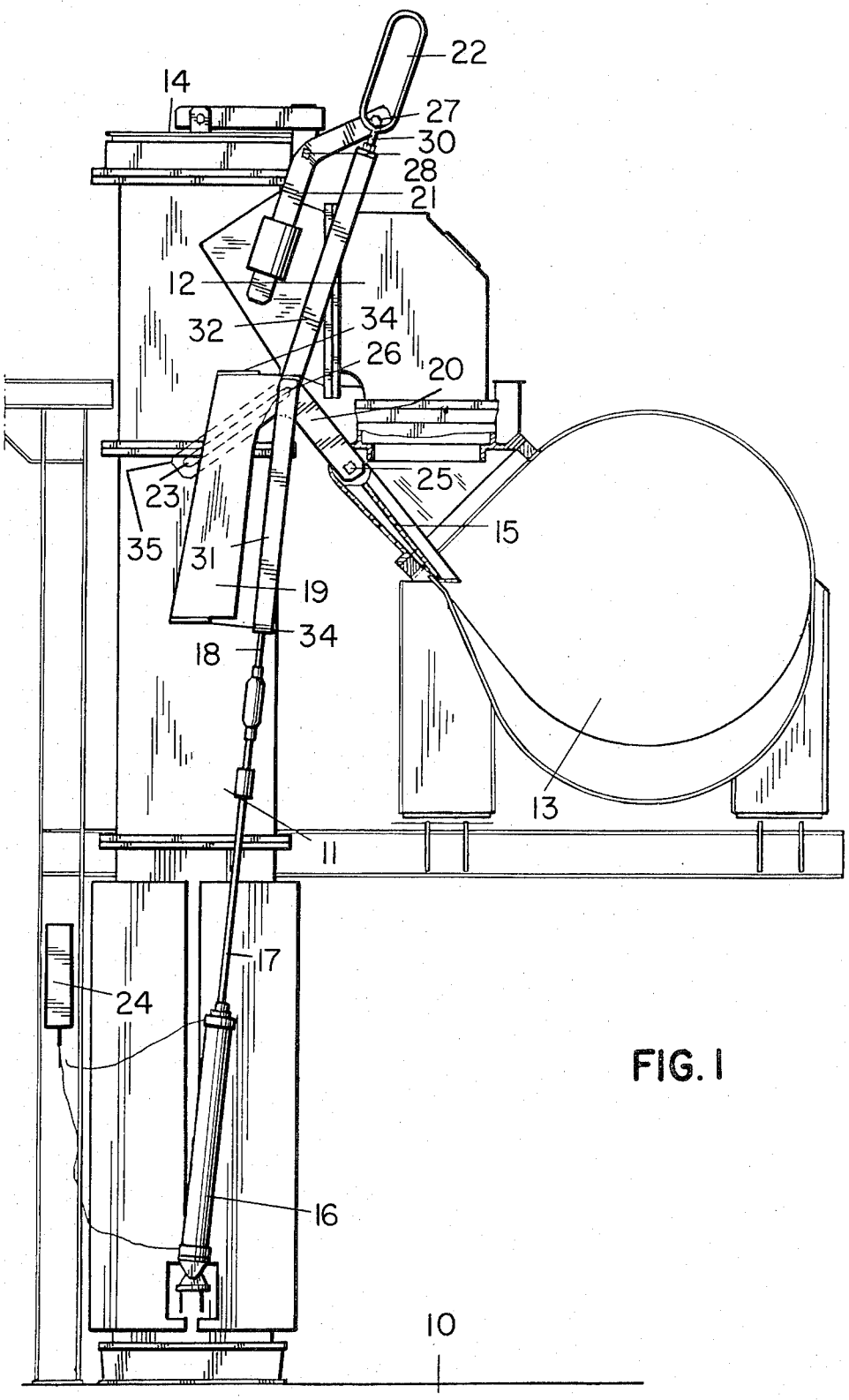
FIG. 1 shows a gas offtake pipe and a gas collection main conduit with a seal open and the offtake pipe cover closed.
Figure 4:
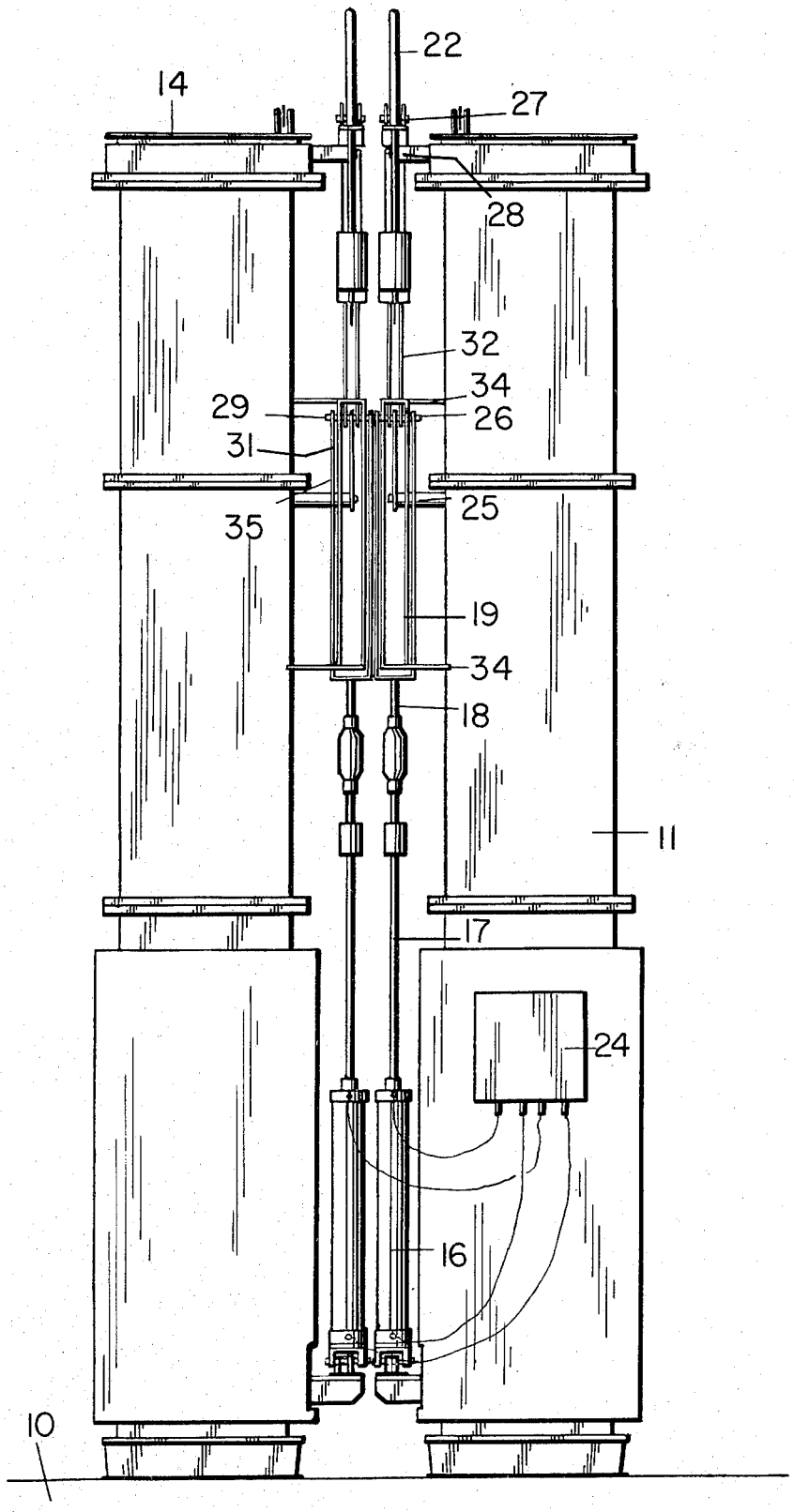
FIG. 4 is a view of two adjacent gas offtake pipes with the present apparatus positioned therebetween.

Referring to FIGS. 1 and 4, the present apparatus is positioned on a coke oven crown 10. Gas offtake pipes 11 rise from the coke oven crown 10 and are closed at their tops by covers 14 which are pivotally mounted on shafts 28 and are normally held in a closed position by means of a weighted arm 21 of a first bell crank arm lever to which the cover 14 is secured.

The gas offtake pipe 11 communicates through a transition element 12 to a gas collection main conduit 13 which has a horizontally presented lengthwise axis. During the coking process, coal distillation vapors rise from the oven crown 10 through the gas offtake pipe 11 and are delivered into the gas collection main conduit 13 through the transition element 12. A seal 15, preferably a water seal, is connected to a second bell crank lever arm 20 and is pivotal about a first pivot pin 26 from an open position shown in FIG. 1 to a closed position shown in FIGS. 2 and 3.

The apparatus includes a first shaft comprising a hydraulic cylinder 16, a piston 17, a draw rod 18 and a forked end 31 which receives the first pivot pin 26. The piston 17 can be extended or retracted from the hydraulic cylinder 16 by means of hydraulic fluid which is supplied from a source 24. It will be observed in FIG. 4 that the hydraulic cylinders 16 are pivotally connected at their bottoms to appropriate brackets.

A second bell crank lever having arms 35, 20 is secured at its center to the first pivot pin 26. The arm 35 is slotted and the first pivot pin 26 is positioned within the slot 23. The seal 15 is rigidly connected to the arm 20 at 25.

A pair of guide rails 19 is secured by retaining members 34 to provide a rail surface to guide the movement of the first pivot pin 26 during operation of the apparatus.

The second shaft 30 has a slot 22 at its upper end to receive a second pin 27 of the first bell crank lever arm 21. The bell crank lever arm 21 is secured to the cover 14 and both are pivotal as a unit about the shaft 28.

OPERATION

Figure 2:
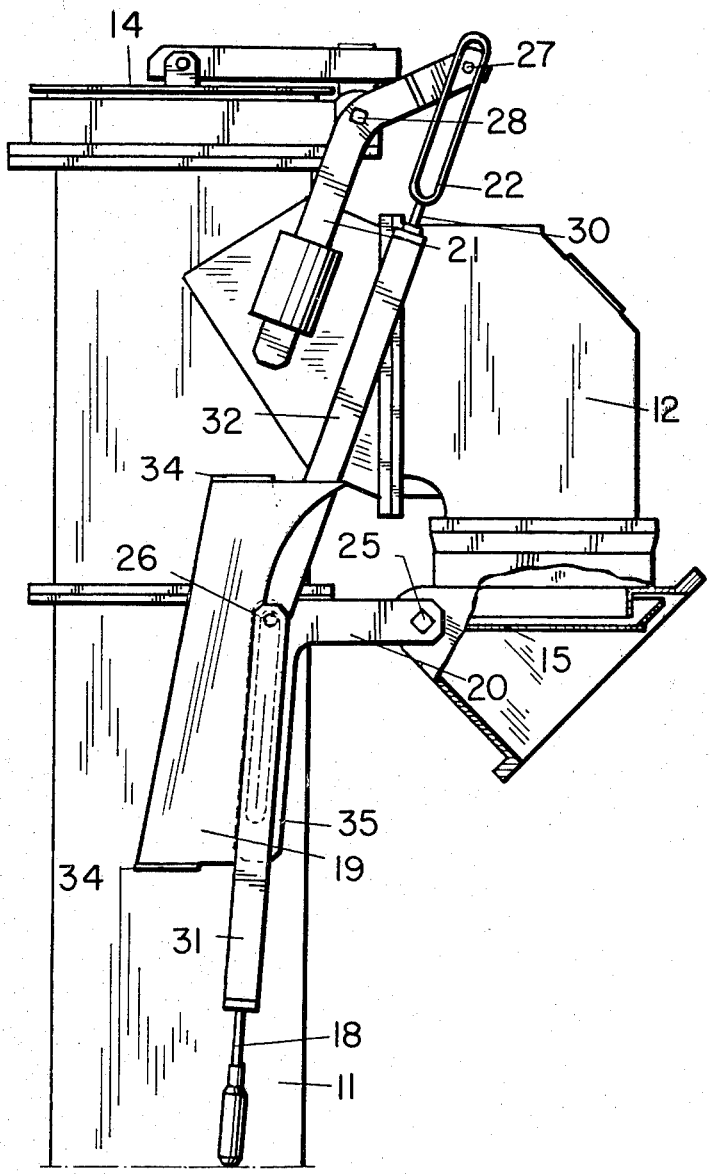
FIG. 2 is a view similar to FIG. 1 on an enlarged scale showing the seal in a closed position and the cover still closed.
Figure 3:
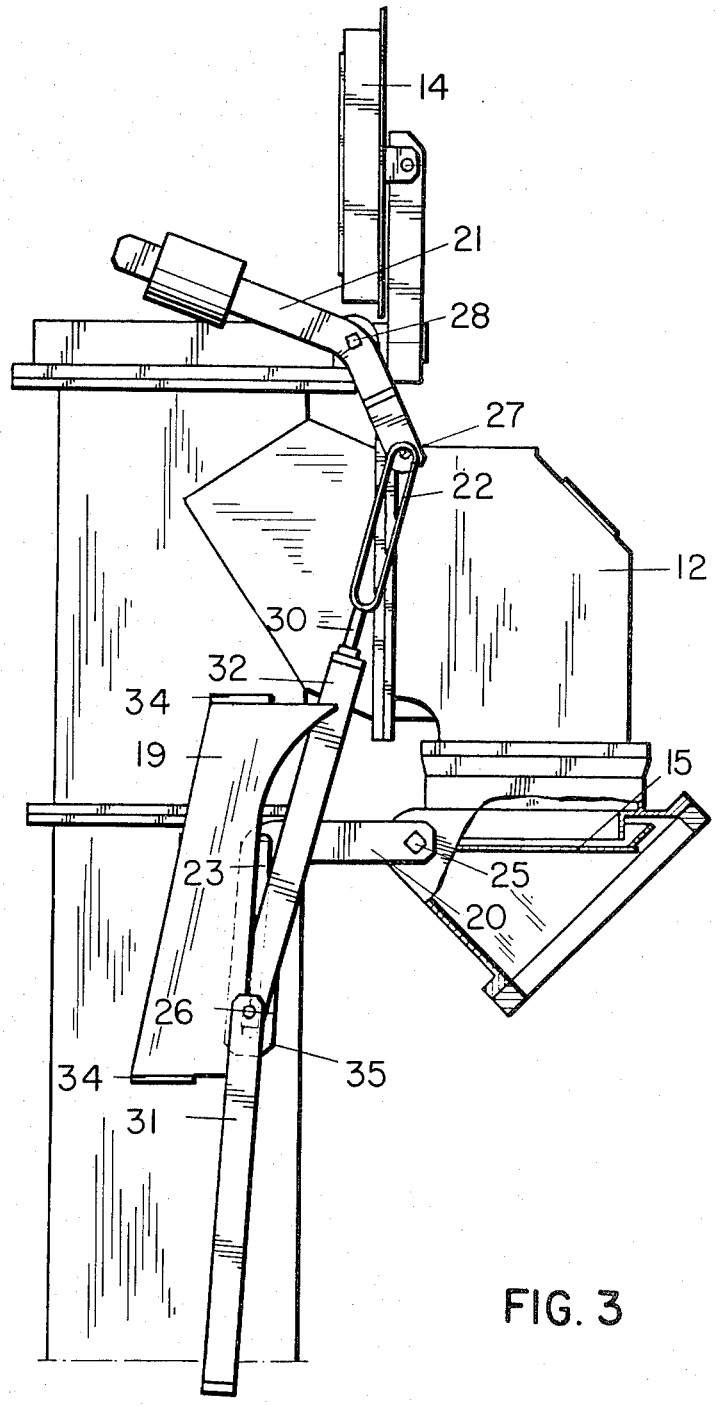
FIG. 3 is a view similar to FIG. 2 with the cover open.

In FIG. 1, the piston 17 is in its fully extended, uppermost position. This is the position in which the apparatus is presented during active coking operations. When coking operations are ending, the piston 17 is retracted. As a result the first shaft 18 and second shaft 30 descend as a unit. The first pivot pin 26 pulls down the two arms 20, 35 of the second bell crank lever into the position which is shown in FIG. 2. Thereby the seal 15 on the second bell crank lever arm 20 is closed and the transition element 12 is sealed from communication with the gas collection main conduit 13. The slotted arm 35 of the second bell crank lever is aligned with the first shaft 18. The slot 22 of the second shaft 32 has moved relative to the second pin 27 but the bell crank lever arm 21 has not moved.

As the piston 17 is retracted farther, the first shaft 18 and second shaft 30 continue to descend. The first pivot pin 26 slides down along the rail 19 within the slot 23 of the second bell crank lever arm 35. The slot 22 at the upper end of the second shaft 30 engages the second pin 27 causing the cover 14 to open.

REVERSE OPERATION

After the coke oven has been cleaned and recharged, the piston 17 is extended and all of the described movements occur in the opposite sequence. That is, the cover 14 initially closes and thereafter the seal 15 opens.

We claim:

1. A coke oven gas apparatus for consecutive operation of a seal on a gas collection main conduit and a cover of a communicating gas offtake pipe, said gas offtake pipe having a vertical axis and having said cover at its top and also communicating through a transition element to a horizontally presented gas collection main conduit, the said seal being disposed to open or close the connection from said transition element to said gas collection main conduit, comprising an extensible and retractable first shaft connected through a first pivot pin at its upper end to the bottom end of a second shaft;

said second shaft connected at its upper end to one end of a first bell crank arm which has a second pivot pin at its center and is connected to the said cover whereby pivotal movement of the said first bell crank arm will move the said cover from an open position to a closed position and vice versa, the other end of said first bell crank arm being weighted to urge the said cover by gravity into a closed position;

said first pivot pin being engaged in a slot in one arm of a second bell crank arm having its other arm secured to the said seal whereby movement of the said second bell crank arm about the said first pivot pin causes the said seal to open and close and vice versa; the connections being such that with the said first shaft in its extended, uppermost position, the said cover is closed and the said seal is open and with the said first shaft in its retracted, bottommost position, the said cover is open and the said seal is closed; said shafts, pivot pins and arms being arranged and constructed such that as the said first shaft extends from its lowermost position, said cover closes and thereafter said seal opens, and as the said first shaft retracts from its uppermost position, the said seal closes and thereafter the said cover opens.

2. The apparatus of claim 1 wherein rail means are provided to guide the movement of the said first pin.

3. The apparatus of claim 2 wherein said rail means comprises a pair of rails, each of which guides said first pivot pin.

4. The apparatus of claim 1 wherein a hydraulic piston is provided to extend and retract the said first shaft.

5. The apparatus of claim 1 wherein the operating apparatus is provided between a pair of gas offtake pipes and is arranged and constructed to operate the covers and seals thereof concurrently.

6. The apparatus of claim 5 wherein the said first shaft is forked at its upper end.

7. The apparatus of claim 6 wherein the said second shaft is forked at its bottom end.

8. The apparatus of claim 7 wherein the said first pivot pin has mounted on it, proceeding from outside to inside, the forked ends of said first shaft, the forked ends of said second shaft and the said second bell crank arm.

9. The apparatus of claim 1 wherein the said seal is a water seal.

* * * * *